US006585413B1

(12) United States Patent
Ward, Jr. et al.

(10) Patent No.: US 6,585,413 B1
(45) **Date of Patent: *Jul. 1, 2003**

(54) SYSTEM FOR A STERILE COLLECTION BAG

(75) Inventors: N. Robert Ward, Jr., Woodinville, WA (US); Geoffrey S. Bright, Bothell, WA (US); Debra K. Cory, East Wenatchee, WA (US)

(73) Assignee: International BioProducts Incorporated, Bothell, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/978,481

(22) Filed: Oct. 16, 2001

(51) Int. Cl.[7] ..... B65D 33/30

(52) U.S. Cl. ..... 383/35; 383/91; 383/204; 383/905

(58) Field of Search ..... 383/90, 91, 204, 383/905, 35, 200, 205

(56) References Cited

U.S. PATENT DOCUMENTS

| | | | | | |
|---|---|---|---|---|---|
| 2,635,788 | A | * | 4/1953 | Snyder et al. | 222/107 |
| 2,973,131 | A | | 2/1961 | Mead et al. | |
| 3,189,253 | A | | 6/1965 | Mojonnier | |
| 3,290,854 | A | * | 12/1966 | MacMurray | 24/30.5 T |
| 3,311,288 | A | * | 3/1967 | Lemelson | 246/415 A |
| 3,315,877 | A | * | 4/1967 | Grevich | 383/211 |
| 3,446,632 | A | * | 5/1969 | Le Van | 426/107 |
| 3,542,190 | A | * | 11/1970 | Keller | 222/107 |
| 3,567,074 | A | * | 3/1971 | Brown | 222/107 |
| 3,616,990 | A | * | 11/1971 | Powell | 206/484 |
| 3,618,850 | A | * | 11/1971 | Palmer | 383/120 |
| 3,719,318 | A | * | 3/1973 | Moran | 24/30.5 T |
| 3,759,439 | A | * | 9/1973 | Cross et al. | 383/205 |
| 3,889,871 | A | | 6/1975 | White | |
| 4,356,954 | A | | 11/1982 | Mojonnier | |
| 4,411,644 | A | * | 10/1983 | Tinklenberg | 206/807 |
| 4,761,079 | A | * | 8/1988 | Wolske | 383/62 |
| 5,054,168 | A | * | 10/1991 | Gandy et al. | 24/30.5 R |
| 5,180,220 | A | | 1/1993 | Van Kalsbeek | |
| 5,180,229 | A | | 1/1993 | Niemeyer | |
| 5,607,748 | A | * | 3/1997 | Feltman | 24/30.5 P |
| 5,766,399 | A | * | 6/1998 | Clark | 156/178 |
| 6,273,608 | B1 | | 8/2001 | Ward, Jr. et al. | |

FOREIGN PATENT DOCUMENTS

| | | |
|---|---|---|
| FR | 1025211 | 4/1953 |
| FR | 2108379 | 5/1972 |
| GB | 936692 | 9/1963 |
| NL | 9000746 | 10/1991 |
| WO | WO 00/26338 A1 | 5/2000 |

* cited by examiner

*Primary Examiner*—Jes F. Pascua
(74) *Attorney, Agent, or Firm*—Christensen O'Connor Johnson Kindness PLLC

(57) ABSTRACT

The body of a sterile collection bag has opposed sidewalls and an upper body end. The interior of the body defines a sterile collection space for an object. First and second flexible closure strips having integrated centrally located wires are attached to the bag sidewalls and extend beyond the side wall edges. The upper end of the body includes one or more small notches cut into the body sidewalls to facilitate tearing of the upper body end from the bag body, with abrupt edges of the strips acting as tear guides. Pull tabs attached to the closure strips can be drawn apart to open the mouth of the bag for insertion of a sample.

22 Claims, 8 Drawing Sheets

SYSTEM FOR A STERILE COLLECTION BAG

FIELD OF THE INVENTION

This invention relates to a special receptacle or package, and more particularly to a reclosable sterile collection bag having a wire closure mechanism.

BACKGROUND OF THE INVENTION

Bags having wire closure mechanisms are currently used to obtain industrial, chemical, and forensic material samples in a sterile manner. For example, U.S. Pat. No. 2,973,131 describes a collection bag having metal wires. Strips of pressure sensitive tape are used to attach the metal wires to opposite sides of the bag. Both the wires and the tape project beyond the side edges of the bag. During use, the bag is filled, the mouth of the bag is closed and rolled against the body of the bag, and the projecting portions of the metal wires are folded back to clamp the rolled end closed. This arrangement has a number of disadvantages. Particularly, the bag can be difficult to open, the wire may not be centered under the tape, and the projecting metal wire ends may puncture adjacent bags during transport prior to use or may puncture a closed bag.

Later inventions have been made to improve the ease with which the bag may be opened. For example, U.S. Pat. Nos. 3,189,253; 4,356,954; and 5,180,220 each use center pull tabs. U.S. Pat. No. 4,356,954 uses downwardly-directed strip ends. U.S. Pat. No. 5,180,229 encloses the wire ends with an additional length of covering material. Although helpful, the arrangements of the above patents are difficult and costly to manufacture and do not result in complete effectiveness with regard to eliminating bag punctures. Further, several targeted improvements have resulted in problems of their own, such as pull tabs or tear strips becoming separated from their bags and falling into (and therefore contaminating) foodstuffs or other products. Thus, a need yet exists for a sterile collection bag that avoids the problems of the prior art sterile collection bags. Ideally, such a bag would be easy to manufacture and convenient to use. In addition, the components of such a bag would not cause premature punctures to the bag body before use or during transport.

SUMMARY OF THE INVENTION

The present invention provides a novel sterile collection bag. The bag includes a body and an opening mechanism. The body is formed of opposed sidewalls and includes an upper body end adjacent to the mouth opening. The interior of the body defines a sterile collection space for a sample object or fluid. The opening mechanism includes first and second flexible closure strips, each having a first end, a second end, and a midsection. In the preferred embodiment, the strips are constructed of plastic with an integrated, centrally located metal wire. The strips are attached to the sidewalls of the bag body and are longer than the width of the body so as to project beyond the sidewall edges. In the preferred embodiment, the projecting ends of the strips are secured to one another. In an alternative embodiment, the projecting ends of the strips are not secured to one another.

In accordance with other aspects of the invention, the ends of each plastic strip can be formed with central indentations adjacent to the ends of the embedded wires. This causes the wire ends to be recessed from the strip ends in such a manner as to reduce the likelihood of unintended bag punctures.

In accordance with another aspect of the invention, the bag is designed in such a way as to prevent the intrusion of air and other contaminants to the interior sterile collection space until its initial use, by sealing the top of the bag. In one embodiment, the bag is formed of linearly oriented polymer film, and one or more lateral notches are cut slightly above the location of the attached flexible closure strips. In another embodiment, non-oriented polymer is used, and the small lateral notches are positioned to facilitate lateral tearing between the two notches, guided by an adjacent edge of a closure strip. These embodiments allow the top of the bag to be torn away for opening upon initial use, but prevent air and other contaminants from entering the interior sterile collection space beforehand.

In accordance with a further aspect of the invention, the opening mechanism includes first and second pull tabs. Each pulltab is attached to the midsection of one of the bag sidewalls, and is constructed of a thin polymer film. In accordance with one aspect of the invention, these pull tabs may be colored in such a manner as to facilitate visual distinction of the pull tabs within the sample collection environment. Similarly, the upper portion of a bag to be torn away for opening can be brightly colored or otherwise prominently marked so that it will be readily visible after removal.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention provides a bag for use in collection, processing, and manipulation of material samples taken for biological, industrial (such as food sampling) and forensic testing.

Figure 1:
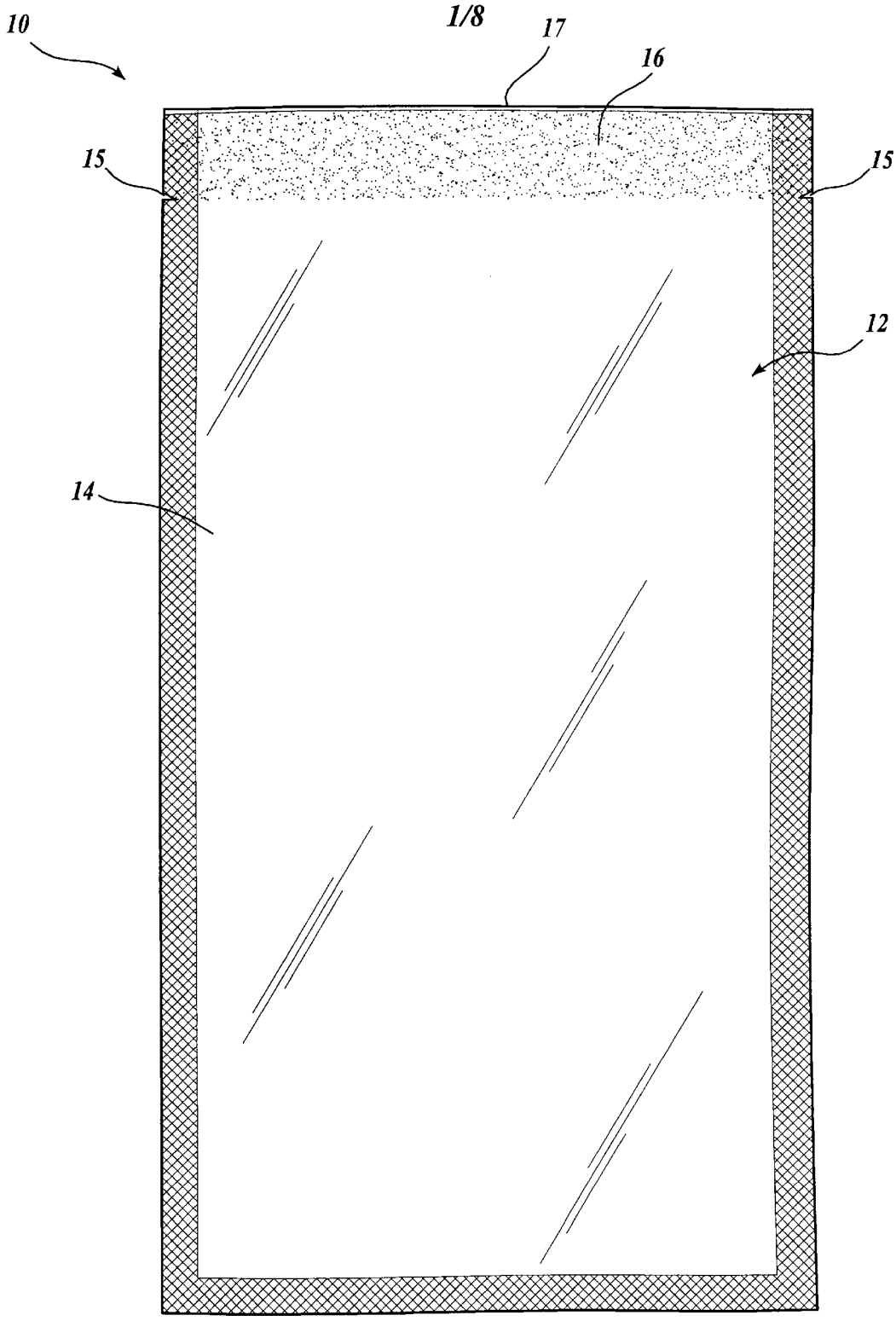
FIG. 1 is a front elevation of a sterile collection bag that can be used in the present invention.

Referring to FIG. 1, the bag 10 includes a body 12 formed of plastic or other known flexible, non-porous collection bag material. The body 12 includes opposed front and rear walls 14 and an upper body end 16. Each sidewall 14 has an exterior surface and a center section. The bottom and side edges of the sidewalls are sealed, such as by conventional heat sealing or adhesive, represented by the cross-hatching along the bottom and side marginal portions. The top edge 17 also is sealed. The interior of the body 12 defines a sterile collection space for a sample to be placed. Notches 15 are provided at the side edges of the sidewalls 14 at the juncture between the bag body 12 and upper body end 16. Preferably the upper body end 16 is brightly colored or otherwise prominently marked (represented by stippling in the drawings) so as to be readily visible when separated from the remainder of the bag structure as described below.

Figure 2:
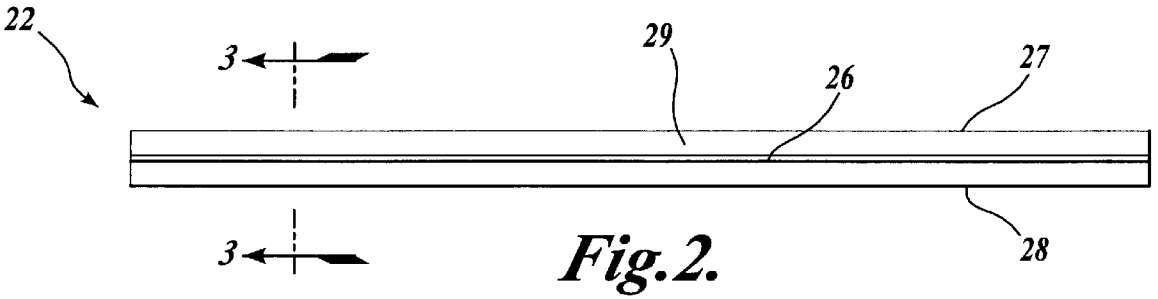
FIG. 2 is a front elevation of a closure strip for use with the bag of FIG. 1.
Figure 3:
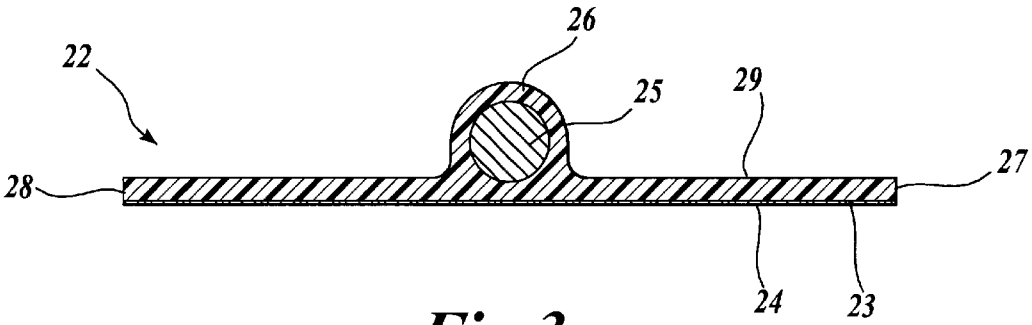
FIG. 3 is an enlarged section along line 3—3 of FIG. 2.

A flexible closure strip 22 usable with the bag of FIG. 1 is illustrated in FIGS. 2 and 3. With reference to FIG. 3, closure strip 22 has an essentially planar backside 23 which may be coated with a layer of adhesive 24. A malleable wire 25 is embedded in a longitudinally extending rib 26 which preferably is located intermediate the top and bottom edges 27, 28 of the strip. Thus, a substantial protrusion is provided on the front side 29 of strip 22. Preferably the wire 25 is entirely surrounded and coated by the plastic material of the strip, so that no part of the midsection of the wire is exposed. The plane of the front side 29 of the strip, ignoring the rib 26, is approximately aligned with the periphery of the embedded wire 25.

The wire is a malleable metal, similar to wires used for common twist ties. The plastic material also is a malleable material having little, if any, memory or spring characteristics, such that a double thickness of strips 22 can be easily bent to a new configuration and retain that configuration until bent back or bent to a new configuration. However, when in the flat configuration illustrated in FIG. 2, at least the top edge 27 of the strip has sufficient thickness so as to be almost rigid as compared to the flexible bag material, with an abrupt corner or corners.

To facilitate bag manufacture and assembly by automatic machinery, the closure strip 22 may be pre-formed in long rolls, prior to application of the adhesive coating 24. Strips of a desired length can be cut from the roll and applied to the bag, all by the automatic machinery. The wires 25 embedded in the pre-formed strips are reliably positioned as desired at the center of the strips. This alleviates the prior problem of misalignment of wires under paper tapes, direct contact of the wires with the bags, and exposed wires.

Figure 4:
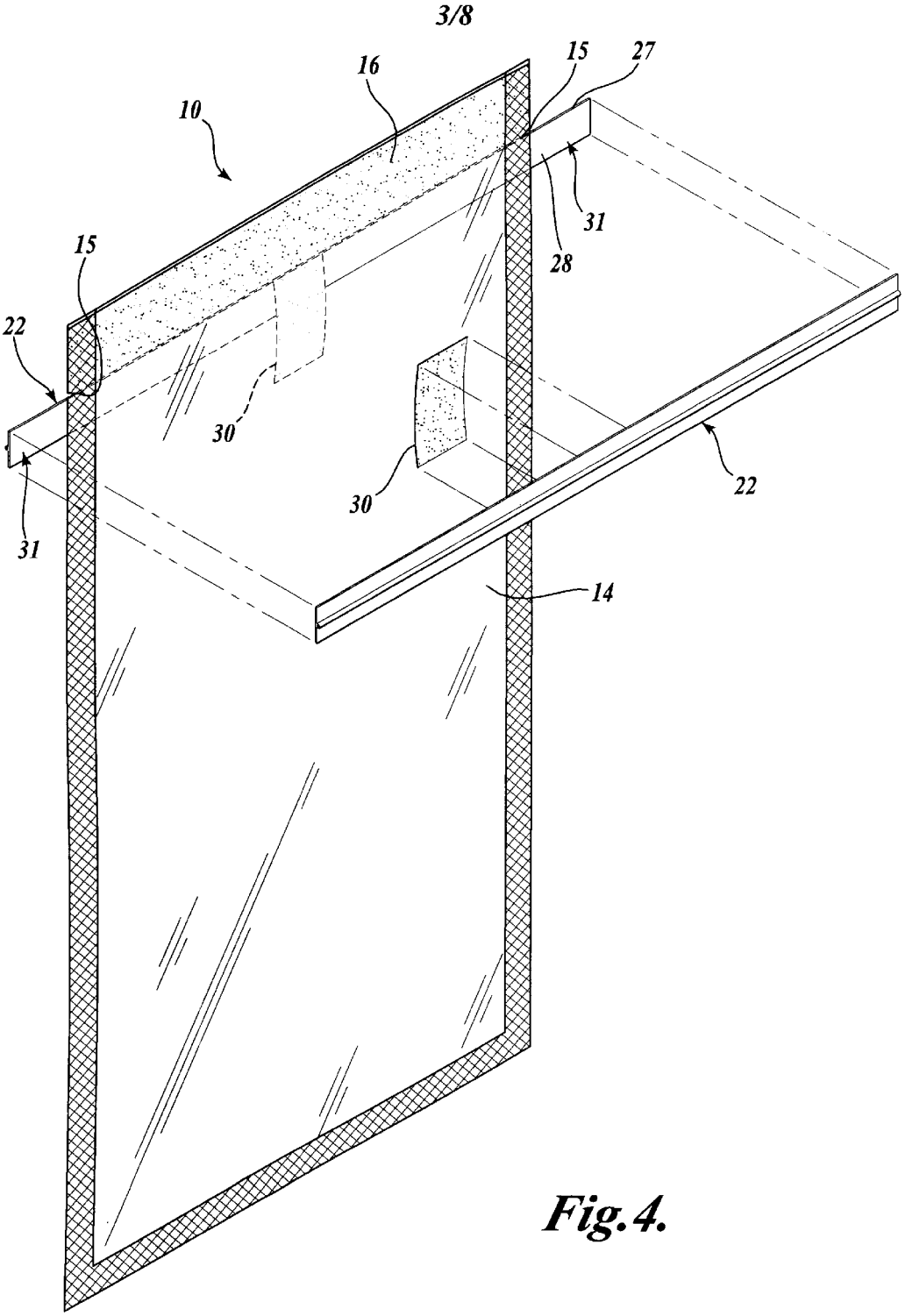
FIG. 4 is a top perspective of a bag in accordance with the present invention with some component parts shown in exploded relationship.

With reference to FIG. 4, in the manufacturing process, a strip 22 is applied to each of the bag sidewalls 14, with its top edge 27 extending between or close beneath the bag notches 15. As seen in the drawings, the front and back strips are in directly opposed relationship. Preferably the manner of attachment is adhesive applied along the midsection and projecting end portions 31 of each strip. Thus such end portions are secured together at their flat rear faces 28. Novel opening tabs 30 have top end portions interposed between the strips 22 and the bag sidewalls 14, and secured thereto by the adhesive. Such tabs have large projecting portions which preferably are square and approximately one inch in width by one inch in length, at least about ¾ inch in each dimension in the preferred embodiment. The projecting parts of these tabs 30 hang loose and are of a textured material suitable for writing indicia on them by a conventional writing instrument such as a pen or pencil, and of non-slippery material, i.e., with a sufficiently high co-efficient of friction that they may be readily grasped between a user's thumb and forefinger, for example, and pulled relatively apart as described below with reference to FIG. 6.

Figure 5:
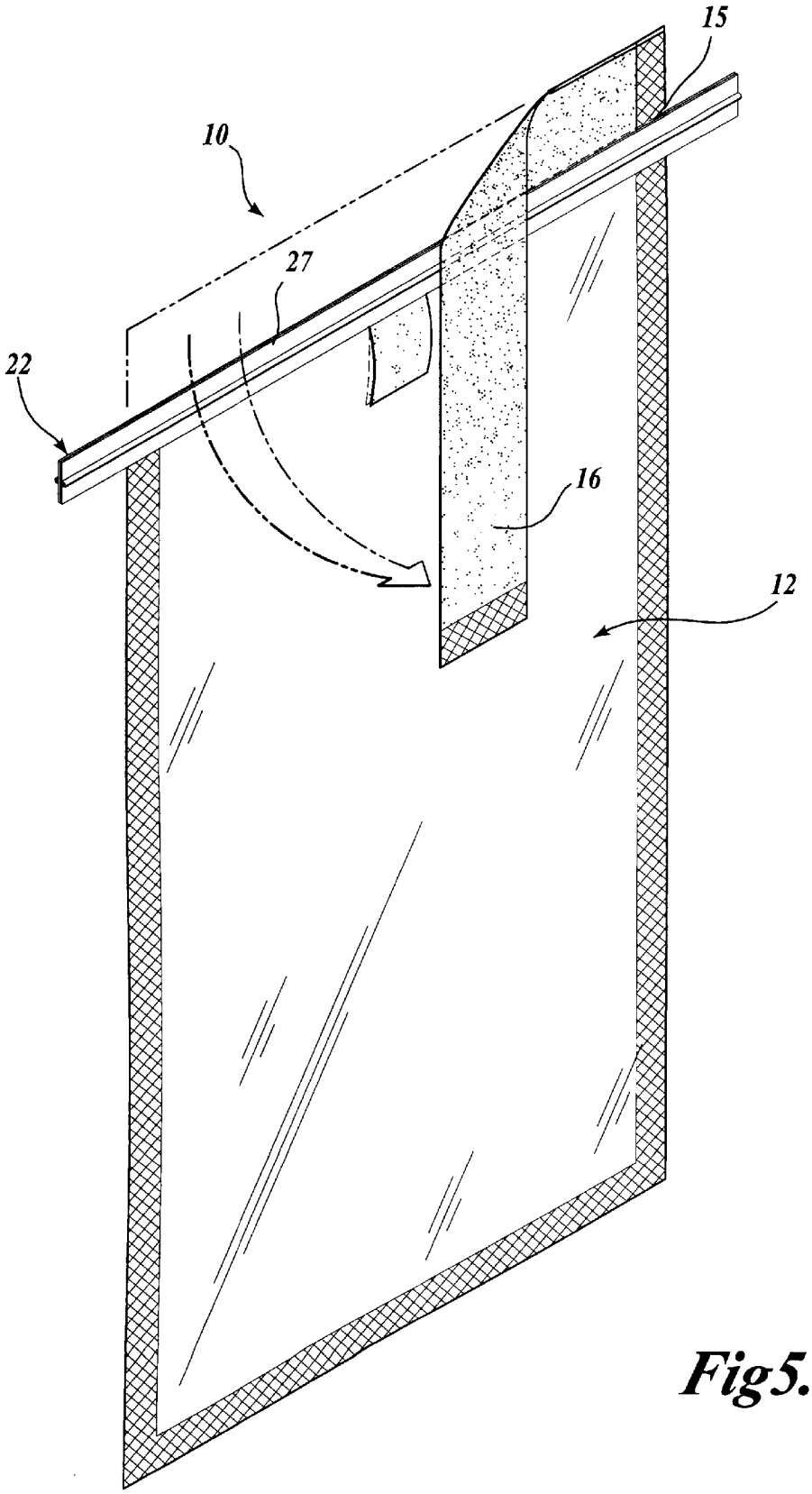
FIG. 5 is a top perspective corresponding to FIG. 4, but with the parts assembled and the bag partially opened prior to use for collection of a sample.

With reference to FIG. 5, the side notches breach the sheer strength of the plastic bag material providing a convenient starting point for a tear across the upper body end 16 of the bag. Preferably the notches do not extend beyond the inner edge of the sealed area which would provide an opening into the interior of the bag that could cause contamination. The upper body end is peeled downward along the top edge 27 of one or the other of the closure strips 22, as shown in FIG. 5. The sharp or abrupt top edge 27 of the strip 22 guides the tear and assists in assuring a clean, complete separation of the upper body end 16 from the body 12 of the bag. The bag material can be a transversely oriented polymer, but an advantage of the invention is that a less expensive nonoriented polymer film can be used without scoring or partial perforation while still allowing the bag to be opened for use by tearing away the top end section 16.

Typically, the bags are formed of a transparent or nearly transparent material, for visualization of any samples held therein. However, it has been found that upper tear strips of a transparent material may fall into the nearby environment, causing possible contamination. The brightly colored or otherwise prominently marked tear strip of the present invention is readily identified so that it will be retrieved if it is inadvertently dropped.

Figure 6:
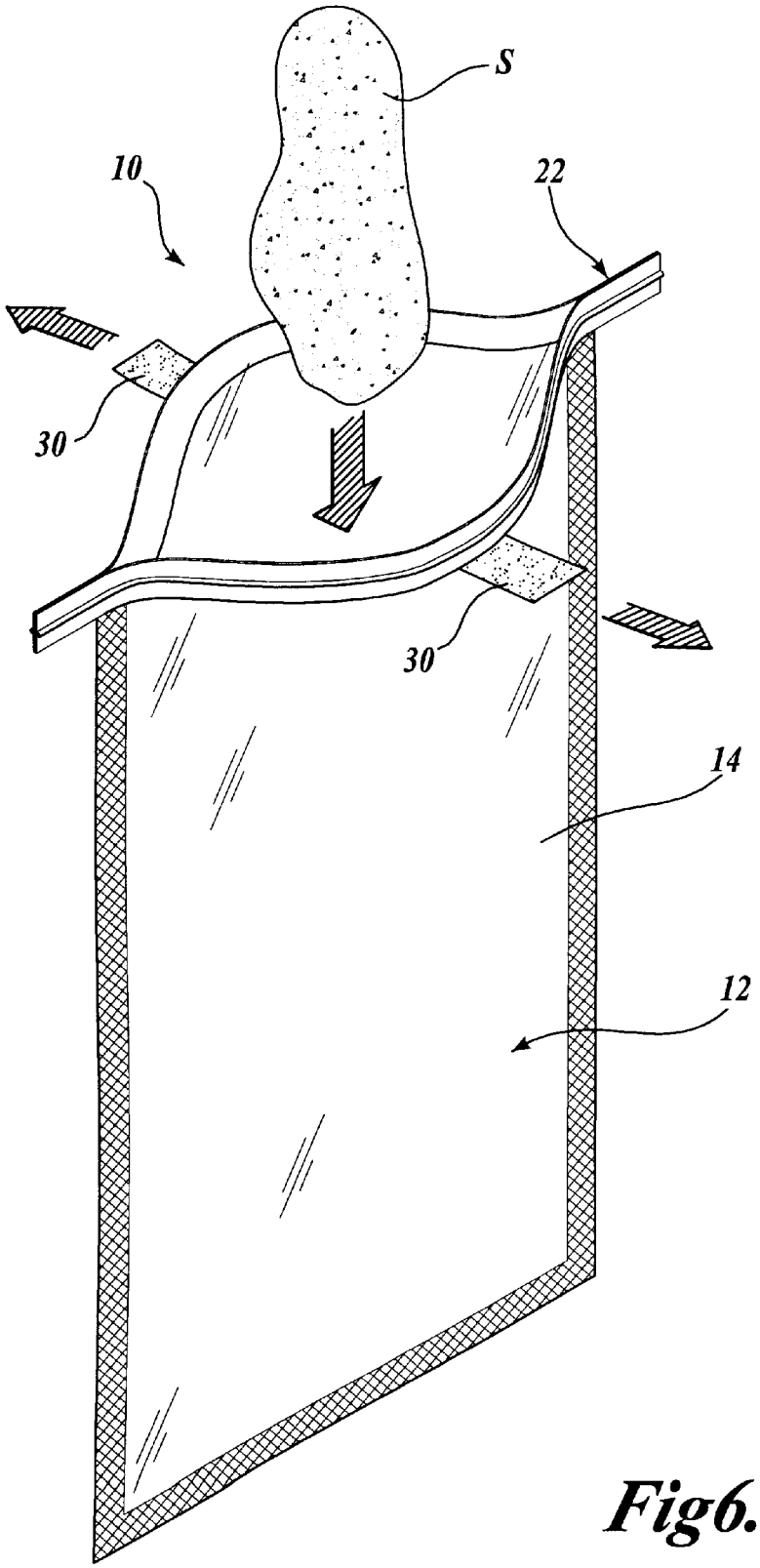
FIG. 6 is a top perspective corresponding to FIG. 5, with the mouth of the bag opened for insertion of a sample.

With reference to FIG. 6, once the upper body end 16 has been torn from the bag, the mouth of the bag can be opened conveniently by pulling on the projecting tabs 30. The desired sample S can be inserted through the open mouth of the bag. For the reasons discussed above, preferably the tabs 30 are brightly colored or otherwise prominently marked in case they become separated from the bag. Also, the non-slippery material, in combination with large tabs, make opening the bag mouth more convenient than in known designs, and the tabs provide a location for marking information concerning the contents, date of collection, etc.

Figure 7:
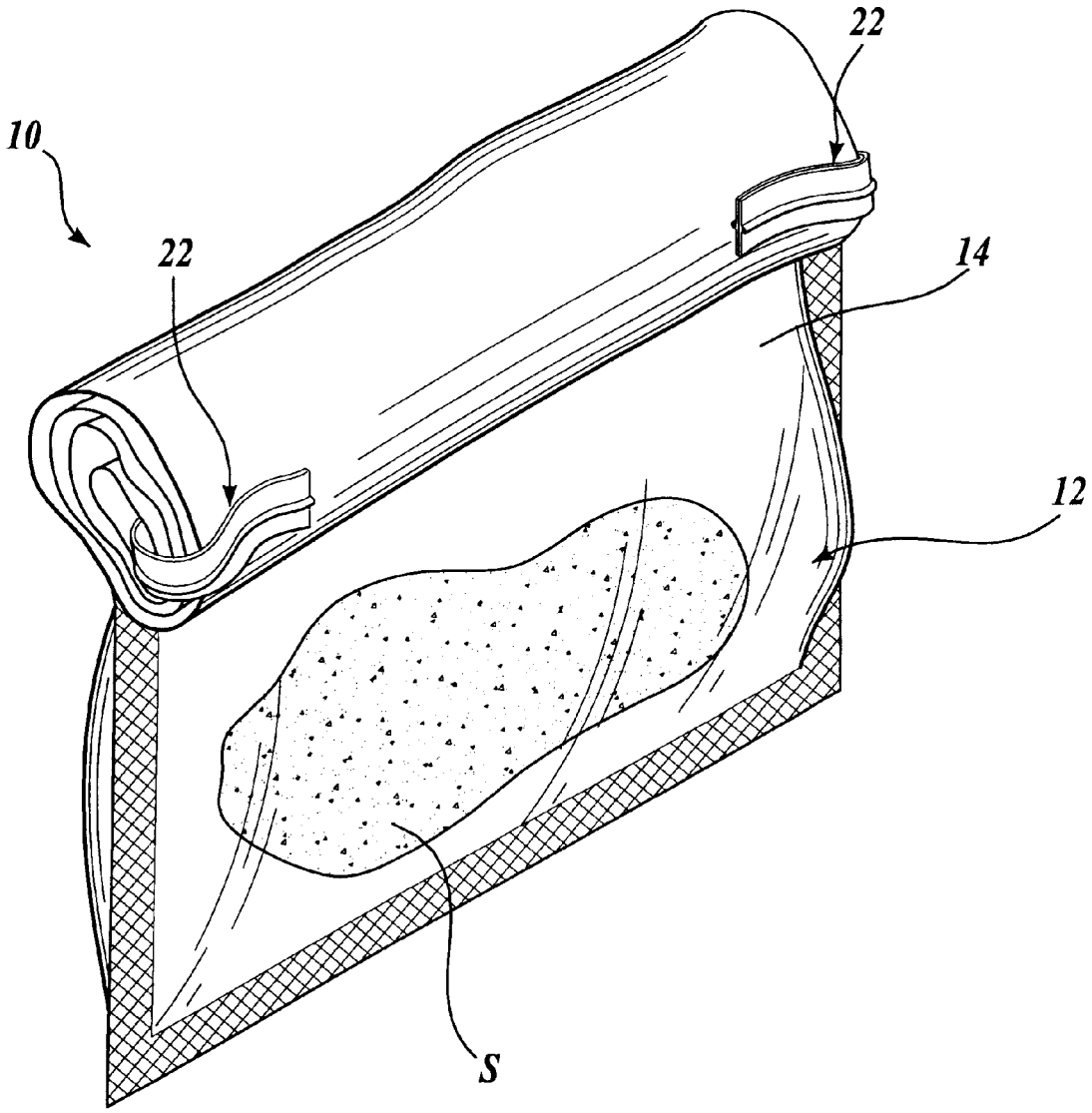
FIG. 7 is a perspective of a bag in accordance with the present invention rolled and clamped closed to retain a collected sample therein.

After insertion of the sample S into the bag, the mouth is closed manually, rolled shut, and the projecting ends of the closure strips folded back onto the body of the bag to clamp it in the closed condition shown in FIG. 7.

Figure 8:
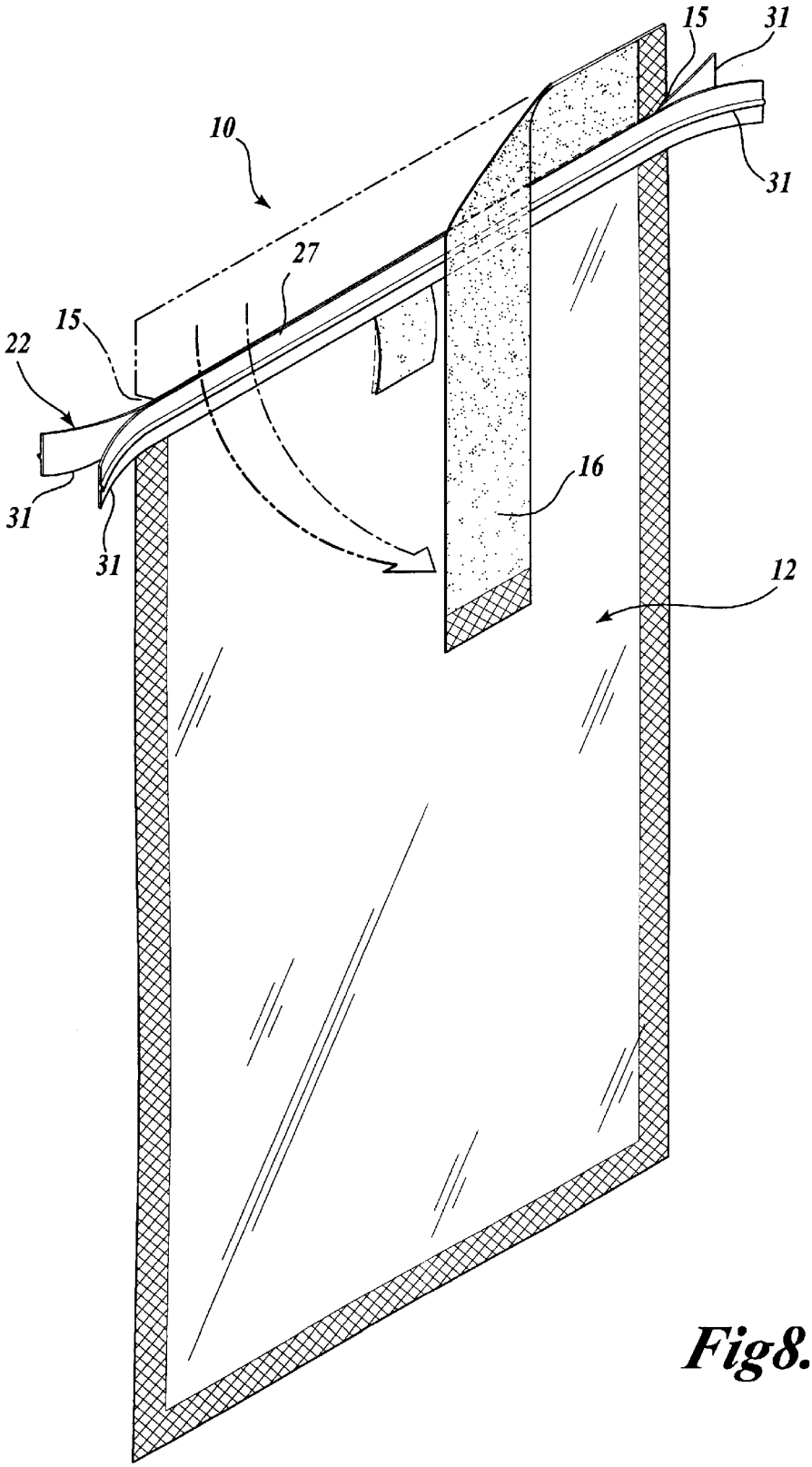
FIG. 8 is a top perspective of an alternative embodiment with the bag partially opened.
Figure 9:
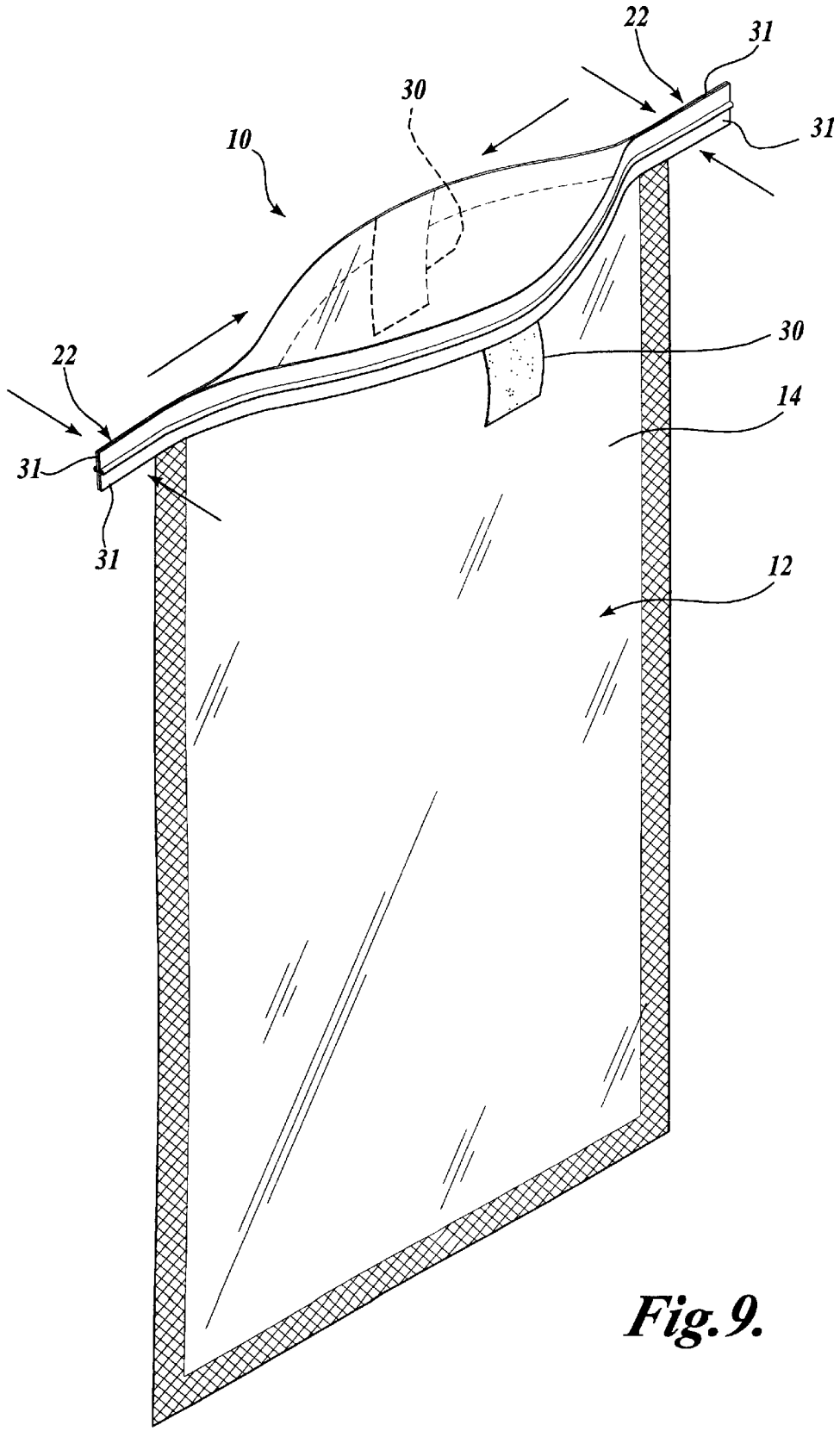
FIG. 9 is a top perspective of the alternative embodiment with the mouth of the bag opened.

In the embodiment illustrated in FIGS. 8 and 9, the projecting end portions 31 of the front and rear closure strips 22 are not secured together. The midsections of the strips are adhered to the bag body, but end portions 31 are unconnected so that they may diverge from each other at a small acute angle from the side edges of the bag to their free ends. Otherwise, the embodiment of FIGS. 8 and 9 is identical to the embodiment previously described. The top end part 16 can be torn beginning from a notch 15 along the abrupt top edge 27 of a strip 22, as shown in FIG. 8. Thereafter, the strip ends 31 can be squeezed together to bias the midsections of the strips apart as seen in FIG. 9. If necessary to achieve a desired degree of opening, the strip ends at one side can be pushed toward the strip ends at the other, or the opening tabs can be used. After insertion of the sample, the mouth of the bag is closed, rolled, and clamped to the condition of FIG. 7.

The ends of the strips 22 can extend straight and perpendicular to the top and bottom strip edges 27, 28 as seen in FIG. 2, for example. The plastic material has less tendency to puncture a bag, and the embedded wire is not exposed to a position where it substantially increases the prospects of a puncture.

Figure 2A:
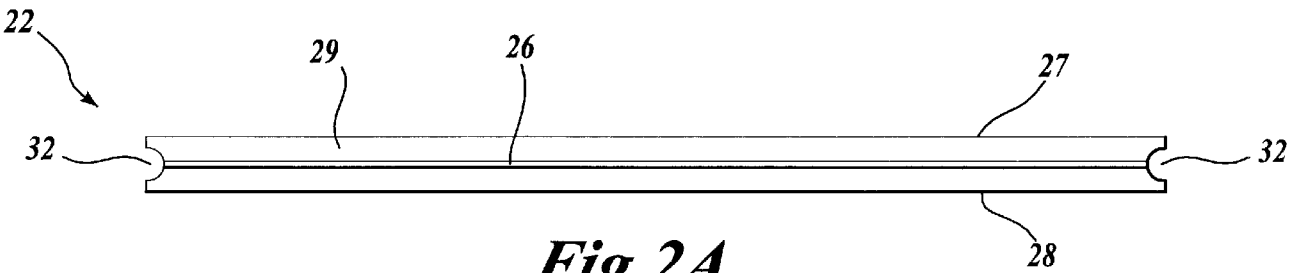
FIG. 2A is a front elevation corresponding to FIG. 2, showing an alternative closure strip that may be used in the invention.

In an alternative embodiment, shown in FIG. 2A, the ends of strips 22 are formed with shallow recesses 32 or central indentations such that the wire ends are offset inward from the plastic strip ends 34. The plastic ends are broader and more blunt than the wires, and much less likely to cause unintended punctures.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A collection bag comprising:

a body including opposed sidewalls and an upper body end, the body having a width, each sidewall being constructed of polymer film and having an exterior surface and a center section, the body having bottom, top and sidewall edges and an interior collection space for a sample; and an opening mechanism located near the upper body end and generally parallel thereto, the opening mechanism including first and second flexible closure members extending widthwise of the body, each closure member including a plastic strip having a first end and a second end and a centrally located malleable wire embedded therein, the closure members being attached to the sidewall exterior surfaces of the body in directly opposed relationship, each flexible closure member being longer than the width of the body so as to project beyond the sidewall edges, the closure members having substantially rigid and abrupt edges adjacent to the upper body end to facilitate transverse tearing of the polymer film along the rigid and abrupt edges for removal of the upper body end with the rigid and abrupt edges serving as lateral tear guides.

2. The bag of claim 1, in which the bottom, top and sidewall edges of the body are sealed.

3. The bag of claim 2, in which the ends of the closure members projecting beyond the sidewall edges are secured together.

4. The bag of claim 2, in which the opening mechanism includes first and second pull tabs formed of thin sheet material, each pull tab being attached to the midsection of a sidewall exterior surface, said pull tabs providing a means for drawing the sidewalls of the bag away from one another.

5. The bag of claim 4, in which each pull tab has a portion interposed between the bag body and the adjacent closure member and a projecting portion hanging loose relative to the bag body.

6. The bag of claim 5, in which the projecting portion of each tab is brightly colored or permanently marked.

7. The bag of claim 5, in which the projecting portion of each tab is textured for writing of identifying indicia thereon.

8. The bag of claim 2, in which the upper body end is brightly colored or permanently marked.

9. The bag of claim 2, wherein at least a first end of each plastic strip has a central indentation such that the end of the malleable wire is recessed relative to the adjacent end of the plastic strip.

10. The bag of claim 2, in which the plastic strips have opposite longitudinal edges and front and back surfaces extending between said edges, the back surfaces being flat and the front surfaces having respective central projecting ribs in which the wires are embedded.

11. The bag of claim 2, in which the ends of the closure members projecting beyond the sidewall edges are not secured together.

12. A sterile collection bag comprising:

a body including opposed sidewalls and an upper body end, the body having a width, each sidewall being constructed of polymer film and having an exterior surface and a center section, the body having bottom, top and sidewall edges and an interior collection space for a sample, the sidewall edges having sealed marginal portions; and an opening mechanism located near the upper body end and generally parallel thereto, the opening mechanism including first and second flexible closure members extending widthwise of the body, each closure member including a plastic strip having a first end and a second end and a centrally located malleable wire embedded therein, the closure members being attached to the sidewall exterior surfaces of the body in directly opposed relationship, each flexible closure member being longer than the width of the body so as to project beyond the sidewall edges, the closure members having substantially rigid and abrupt edges adjacent to the upper body end to facilitate transverse tearing of the polymer film along the rigid and abrupt edges for removal of the upper body end with the rigid and abrupt edges serving as a lateral tear guide, the body including at least one notch formed in one of the sidewall edges without penetrating beyond the corresponding sealed marginal portion at a location adjacent to the closure members.

13. The bag of claim 12, in which the bottom and top edges of the body are sealed.

14. The bag of claim 13, in which the ends of the closure members projecting beyond the sidewall edges are secured together.

15. The bag of claim 13, in which the opening mechanism includes first and second pull tabs formed of thin sheet material, each pull tab being attached to the midsection of a sidewall exterior surface, said pull tabs providing a means for drawing the sidewalls of the bag away from one another.

16. The bag of claim 15, in which each pull tab has a portion interposed between the bag body and the adjacent closure member and a projecting portion hanging loose relative to the bag body.

17. The bag of claim 16, in which the projecting portion of each tab is brightly colored or permanently marked.

18. The bag of claim 16, in which the projecting portion of each tab is textured for writing of identifying indicia thereon.

19. The bag of claim 13, in which the upper body end is brightly colored or permanently marked.

20. The bag of claim 13, wherein at least a first end of each plastic strip has a central indentation such that the end of the malleable wire is recessed relative to the adjacent end of the plastic strip.

21. The bag of claim 13, in which the plastic strips have opposite longitudinal edges and front and back surfaces extending between said edges, the back surfaces being flat and the front surfaces having respective central projecting ribs in which the wires are embedded.

22. The bag of claim 13, in which the ends of the closure members projecting beyond the sidewall edges are not secured together.

* * * * *

UNITED STATES PATENT AND TRADEMARK OFFICE

CERTIFICATE OF CORRECTION

PATENT NO. : 6,585,413 B1
DATED : July 1, 2003
INVENTOR(S) : N.R. Ward, Jr. et al.

It is certified that error appears in the above-identified patent and that said Letters Patent is hereby corrected as shown below:

Title page,
Item [56], References Cited, FOREIGN PATENT DOCUMENTS, insert in appropriate order -- GB 673,004 5/1952 --

Signed and Sealed this

Thirteenth Day of January, 2004

JON W. DUDAS
*Acting Director of the United States Patent and Trademark Office*